US010197325B2

(12) United States Patent
Kim et al.

(10) Patent No.: US 10,197,325 B2
(45) Date of Patent: Feb. 5, 2019

(54) AIR CONDITIONER WITH TWO INJECTION CIRCUITS AND METHOD OF CONTROLLING THE AIR CONDITIONER

(71) Applicant: LG Electronics Inc., Seoul (KR)

(72) Inventors: Beomchan Kim, Seoul (KR); Younghwan Ko, Seoul (KR); Byeongsu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 820 days.

(21) Appl. No.: 14/662,494

(22) Filed: Mar. 19, 2015

(65) Prior Publication Data

US 2015/0267957 A1 Sep. 24, 2015

(30) Foreign Application Priority Data

Mar. 20, 2014 (KR) ..... 10-2014-0032960

(51) Int. Cl.
*F25B 13/00* (2006.01)
*F25D 21/00* (2006.01)
(Continued)

(52) U.S. Cl.
CPC ..... *F25D 21/006* (2013.01); *F25B 47/025* (2013.01); *F25B 49/02* (2013.01); *F25D 21/06* (2013.01); *F25B 1/10* (2013.01); *F25B 13/00* (2013.01); *F25B 2313/029* (2013.01); *F25B 2341/066* (2013.01); *F25B 2347/02* (2013.01);
(Continued)

(58) Field of Classification Search
CPC .... F25B 13/00; F25B 47/025; F25B 2347/02; F25B 2400/13; F25B 2600/2509; F25B 2700/11
See application file for complete search history.

(56) References Cited

U.S. PATENT DOCUMENTS 6,405,559 B1 * 6/2002 Yoneda ..... F25B 40/02 62/200
6,694,750 B1 * 2/2004 Lifson ..... F25B 1/047 62/113
(Continued)

OTHER PUBLICATIONS

European Search Report issued in Application No. 15160063.2 dated Aug. 28, 2015.

*Primary Examiner* — Jonathan Bradford
(74) *Attorney, Agent, or Firm* — KED & Associates LLP

(57) ABSTRACT

An air conditioner and a method for controlling an air conditioner are provided that inject a refrigerant into a compressor to perform a defrosting operation. The air conditioner may include a compressor; an outdoor heat exchanger; an indoor heat exchanger; a first injection module that injects a refrigerant flowing from the indoor heat exchanger to the outdoor heat exchanger into the compressor during a heating operation and that does not inject a refrigerant flowing from the outdoor heat exchanger to the indoor heat exchanger into the compressor during a defrosting operation; and a second injection module that injects a refrigerant flowing from the indoor heat exchanger to the outdoor heat exchanger into the compressor during the heating operation and that injects a refrigerant flowing from the outdoor heat exchanger to the indoor heat exchanger into the compressor during the defrosting operation.

11 Claims, 7 Drawing Sheets

(51) Int. Cl.

| | |
|---|---|
| ***F25D 21/06*** | (2006.01) |
| ***F25B 47/02*** | (2006.01) |
| ***F25B 49/02*** | (2006.01) |
| *F25B 1/10* | (2006.01) |

(52) U.S. Cl.
CPC ..... *F25B 2400/13* (2013.01); *F25B 2500/19* (2013.01); *F25B 2600/2509* (2013.01); *F25B 2600/2513* (2013.01); *F25B 2700/11* (2013.01); *F25B 2700/2116* (2013.01); *F25B 2700/21152* (2013.01)

(56) References Cited

U.S. PATENT DOCUMENTS

| | | | | |
|---|---|---|---|---|
| 2004/0035122 | A1 | 2/2004 | Lifson et al. | |
| 2005/0086957 | A1* | 4/2005 | Lifson | F25B 49/005 62/196.3 |
| 2006/0080989 | A1* | 4/2006 | Aoki | F25B 13/00 62/324.4 |
| 2010/0212342 | A1* | 8/2010 | Jeong | F25B 41/00 62/208 |
| 2010/0223939 | A1* | 9/2010 | Mitra | F25B 1/10 62/117 |
| 2013/0081425 | A1 | 4/2013 | Jang et al. | |
| 2013/0219927 | A1 | 8/2013 | Kim et al. | |
| 2014/0026605 | A1* | 1/2014 | Ishimura | F25B 1/00 62/222 |

* cited by examiner

AIR CONDITIONER WITH TWO INJECTION CIRCUITS AND METHOD OF CONTROLLING THE AIR CONDITIONER

CROSS-REFERENCE TO RELATED APPLICATION(S)

This application claims priority under 35 U.S.C. § 119 to Korean Application No. 10-2014-0032960 filed in Korea on Mar. 20, 2014, whose entire disclosure is hereby incorporated by reference.

BACKGROUND

1. Field

An air conditioner and a method for controlling an air conditioner are disclosed herein.

2. Background

In general, an air conditioner including a compressor, an outdoor heat exchanger, an expansion valve, and an indoor heat exchanger heats or cools an indoor space using a refrigeration cycle. That is, the air conditioner may include a cooler to cool the indoor space and a heater to heat the indoor space. In addition, the air conditioner may be used for both heating and cooling the indoor space.

When the air conditioner is configured for both heating and cooling, it may include a valve unit or valve that changes flowing paths of the refrigerant compressed at the compressor according to a cooling operation, a heating operation, and a defrosting operation. That is, the refrigerant compressed at the compressor may flow to the outdoor heat exchanger via the valve unit on or when performing the cooling operation wherein the outdoor heat exchanger acts as a condenser. Further, the refrigerant condensed at the outdoor heat exchanger may be expanded at the expansion valve, and then, may be introduced into the indoor heat exchanger. At this moment, the indoor heat exchanger may act as the evaporator, and the refrigerant evaporated at the indoor heat exchanger may be introduced again into the compressor via the valve unit.

Frost may be generated at or on the outdoor heat exchanger of the air conditioner, when an outdoor temperature is low, on or when performing the heating operation. Heating efficiency may be lowered when the frost is generated at the outdoor heat exchanger. Therefore, in order to remove the frost generated at the outdoor heat exchanger, the air conditioner may perform the defrosting operation to introduce the refrigerant, having a high temperature, compressed at the compressor into the outdoor heat exchanger.

In order to enhance efficiency of the air conditioner on or when performing the defrosting operation, it is required that refrigerant be injected into the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
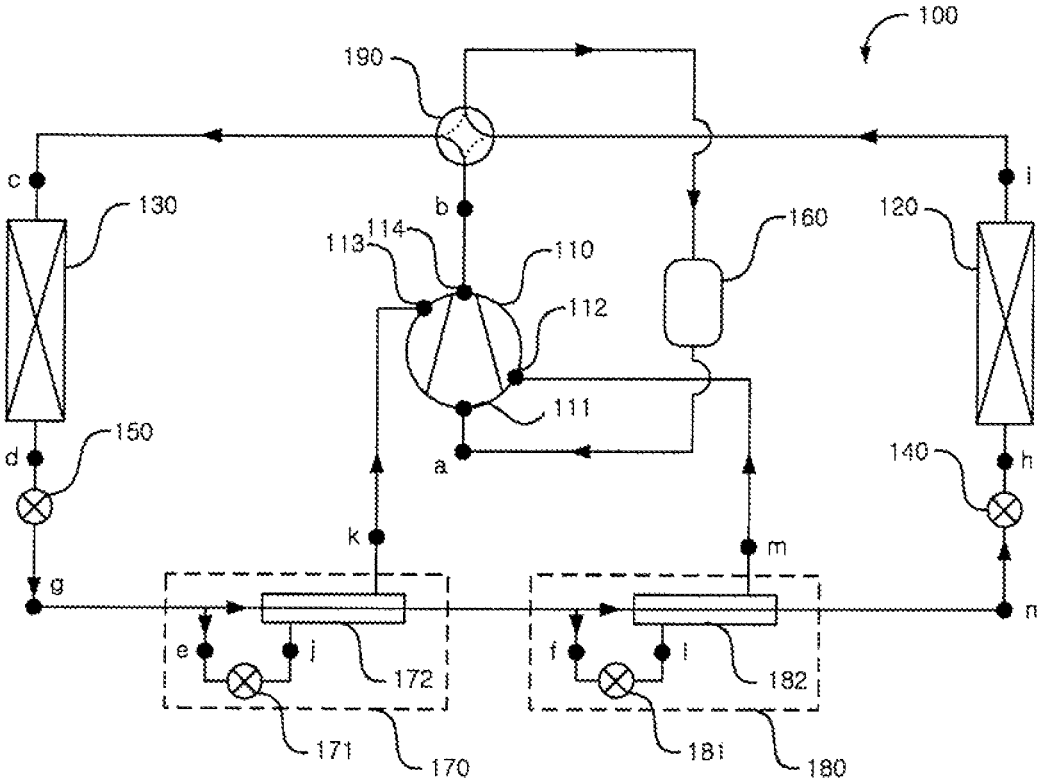
FIG. 1 is a schematic diagram showing refrigerant flow during a heating operation in an air-conditioner according to an embodiment.

Hereinafter, embodiments will be described with reference to the drawings for an air-conditioner and a method for controlling an air conditioner. Where possible, like reference numerals have been used to indicate like elements, and repetitive disclosure has been omitted.

FIG. 1 is a schematic diagram showing refrigerant flow during a heating operation in an air-conditioner according to an embodiment. The air-conditioner 100 may include a compressor 110 to compress a refrigerant, an outdoor heat exchanger 120, disposed at an outdoor space, to heat-exchange outdoor air with the refrigerant, an indoor heat exchanger 130, disposed at an indoor space, to heat-exchange indoor air with the refrigerant, a valve unit or valve 190 to guide the refrigerant discharged from the compressor 110 to the indoor heat exchanger 130 on or when performing a heating operation and to guide the refrigerant discharged from the compressor 110 to the outdoor heat exchanger 120 on or when performing a defrosting operation, a first injection module 170 that injects some or a portion of the refrigerant flowing from the indoor heat exchanger 130 to the outdoor heat exchanger 120 into the compressor 110 on or when performing the heating operation and does not inject some or a portion of the refrigerant flowing from the outdoor heat exchanger 120 to the indoor heat exchanger 130 into the compressor 110 on or when performing the defrosting operation, and a second injection module 180 that injects some or a portion of the refrigerant flowing from the indoor heat exchanger 130 to the outdoor heat exchanger 120 into the compressor 110 on or when performing the heating operation and that injects some or a portion of the refrigerant flowing from the outdoor heat exchanger 120 to the indoor heat exchanger 130 into the compressor 110 on or when performing the defrosting operation.

The compressor 110 may compress the refrigerant, having a low temperature and pressure, into the refrigerant having a high temperature and pressure. The compressor 110 may have various structures, and may be a reciprocating compressor using a cylinder and a piston, or a scroll compressor using a orbiting pivot scroll and a fixed scroll, for example. The compressor 110 may be a scroll compressor in this embodiment. A plurality of compressors 110 may be provided according to an embodiment.

The compressor 110 may include a first inlet port 111 to introduce the refrigerant evaporated at the outdoor heat exchanger 120 on or when performing the heating operation or to introduce the refrigerant evaporated at the indoor heat exchanger 130 on or when performing the defrosting operation, a second inlet port 112 to introduce a comparative low pressure refrigerant expanded and evaporated at the second injection module 180, a third inlet port 113 to introduce a comparative high pressure refrigerant expanded and evaporated at the first injection module 170, and a discharge port 114 to discharge the compressed refrigerant.

According to one embodiment, the heating operation may condense the refrigerant at the indoor heat exchanger 130 and heat indoor air, and the defrosting operation may condense the refrigerant at the outdoor heat exchanger 120 and remove frost generated at the outdoor heat exchanger 120. The defrosting operation may be performed in a case of satisfying defrosting conditions during the heating operation. The defrosting conditions may be variously set by conditions that may remove the frost at the outdoor heat exchanger 120, and may be set as a case in which temperatures of the outdoor heat exchanger 120 and/or surrounding pipes thereof are below a predetermined temperature according to this embodiment.

The second inlet port 112 may be formed at a low pressure side of a compression chamber in which the refrigerant is compressed in the compressor 110, and the third inlet port 113 may be formed at a high pressure side of the compression chamber. The high pressure side of the compression chamber may be a portion having a comparatively higher temperature and pressure than the low pressure side of the compression chamber.

The refrigerant introduced into the first inlet port 111 may have a lower temperature and pressure than the refrigerant introduced into the second inlet port 112, and the refrigerant introduced into the second inlet port 112 may have a lower temperature and pressure than the refrigerant introduced into the third inlet port 113. The refrigerant introduced into the third inlet port 113 may have a lower temperature and pressure than the refrigerant discharged to the discharge port 114.

The compressor 110 may compress the refrigerant introduced into the first inlet port 111 in the compression chamber, combine it with the refrigerant introduced into the second inlet port 112 formed at the low pressure side of the compression chamber, and compress the combined refrigerant. The compressor 110 may compress the combined refrigerant, combined it with the refrigerant introduced into the third inlet port 113 formed at the high pressure side of the compression chamber, and compress the combined refrigerant. The compressor 110 may compress the combined refrigerant and discharge it to the discharge port 114.

A liquid-vapor separator 160 may separate a vapor-phase refrigerant and a liquid-phase refrigerant from the refrigerant evaporated at the indoor heat exchanger 130 on or when performing the defrosting operation or the refrigerant evaporated at the outdoor heat exchanger 120 on or when performing the heating operation. The liquid-vapor separator 160 may be disposed between the valve unit 190 and the first inlet port 111 of the compressor 110. The vapor-phase refrigerant separated from the liquid-vapor separator 160 may be introduced into the first inlet port 111 of the compressor 110.

The valve unit 190, which may be a flow path switching valve to switch cooling and heating, may guide the refrigerant compressed at the compressor 110 to the indoor heat exchanger 130 on or when performing the heating operation and guide the refrigerant compressed at the compressor 110 to the outdoor heat exchanger 120 on or when performing the defrosting operation. The valve unit 190 may be connected to the discharge port 114 of the compressor 110 and the liquid-vapor separator 160, and to the indoor heat exchanger 130 and the outdoor heat exchanger 120. The valve unit 190 may connect the discharge port 114 of the compressor 110 and the indoor heat exchanger 130 and connect the outdoor heat exchanger 120 and the liquid-vapor separator 160, on or when performing the heating operation. The valve unit 190 may connect the discharge port 114 of the compressor 110 and the outdoor heat exchanger 120 and connect the indoor heat exchanger 130 and the liquid-vapor separator 160, on or when performing the defrosting operation.

The valve unit 190 may be implemented using various modules capable of connecting flow paths different from each other, and may be, for example, a four-way valve to switch the flow path. Alternatively, the valve unit 190 may be implemented as various valves, such as a combination of two three-way valves capable of switching four flow paths or a combination thereof.

The outdoor heat exchanger 120 at an outdoor space may heat-exchange the refrigerant passing through the outdoor heat exchanger 120 with outdoor air. The outdoor heat exchanger 120 may act as an evaporator that evaporates the refrigerant on or when performing the heating operation and as a condenser that condenses the refrigerant on or when performing the defrosting operation.

The outdoor heat exchanger 120 may be connected to the valve unit 190 and an outdoor expansion valve 140. The refrigerant expanded at the outdoor expansion valve 140 may be introduced into the outdoor heat exchanger 120 on or when performing the heating operation, the introduced refrigerant may be evaporated, and then, the evaporated refrigerant may be discharged to the valve unit 190. The refrigerant may be compressed at the compressor 110 and pass through the discharge port 114 of the compressor 110 and the valve unit 190, on or when performing the defrosting operation, may be introduced into the outdoor heat exchanger 120, the introduced refrigerant may be condensed, and then, the condensed refrigerant may flow to the outdoor expansion valve 140.

An opening of the outdoor expansion valve 140 may be controlled on or when performing the heating operation, to expand the refrigerant, and may be completely opened and pass the refrigerant on or when performing the defrosting operation. The outdoor expansion valve 140 may be connected to the outdoor heat exchanger 120 and the second injection module 180. The outdoor expansion valve 140 may be disposed between the outdoor heat exchanger 120 and the second injection module 180.

The outdoor expansion valve 140 may expand the refrigerant flowing from the second injection module 180 to the outdoor heat exchanger 120 on or when performing the heating operation. The outdoor expansion valve 140 may pass the refrigerant introduced from the outdoor heat exchanger 120 on or when performing the defrosting operation and guide the refrigerant to the second injection module 180.

The indoor heat exchanger 130 at an indoor space may heat-exchange the refrigerant passing through the indoor heat exchanger 130 with indoor air. The indoor heat exchanger 130 may act as a condenser to condense the refrigerant on or when performing the heating operation and as an evaporator to evaporate the refrigerant on or when performing the defrosting operation.

The indoor heat exchanger 130 may be connected to the valve unit 190 and an indoor expansion valve 150. The refrigerant may be compressed at the compressor 110 and pass through the discharge port 114 of the compressor 110 and the valve unit 190 on or when performing the heating operation, may be introduced into the indoor heat exchanger 130, the introduced refrigerant may be condensed, and then, the condensed refrigerant may flow into the indoor expansion valve 150. The refrigerant expanded at the indoor expansion valve 150 may be introduced into the indoor heat exchanger 130 on or when performing the defrosting operation, the introduced refrigerant may be evaporated, and then, the evaporated refrigerant may be discharged to the valve unit 190.

The indoor expansion valve 150 may be completely opened on or when performing the heating operation to pass the refrigerant therethrough, and the opening of the indoor expansion valve 150 may be controlled on or when performing the defrosting operation and the indoor expansion valve 150 may expand the refrigerant. The indoor expansion valve 150 may be connected to the indoor heat exchanger 130 and the first injection module 170. The indoor expansion valve 150 may be disposed between the indoor heat exchanger 130 and the first injection module 170.

The indoor expansion valve 150 may pass the refrigerant introduced from the indoor heat exchanger 130 on or when performing the heating operation and guide the refrigerant to the first injection module 170. The indoor expansion valve 150 may expand the refrigerant flowing from the first injection module 170 to the indoor heat exchanger 130 on or when performing the defrosting operation.

The first injection module 170 may expand some or a portion of the refrigerant flowing between the indoor heat exchanger 130 and the outdoor heat exchanger 120 according to operation conditions, and inject or not inject the expanded refrigerant into the compressor 110. The first injection module 170 may expand some or a portion of the refrigerant flowing from the indoor heat exchanger 130 to the second injection module 180 on or when performing the heating operation and inject the expanded refrigerant into the high pressure side of the compressor 110. The first injection module 170 may be connected to the indoor expansion valve 150, the third inlet port 113, and the second injection module 180.

The first injection module 170 may guide some or a portion of the refrigerant flowing from the indoor heat exchanger 130 to the third inlet port 113 of the compressor 110 on or when performing the heating operation, inject the refrigerant into the high pressure side of the compressor 110, and guide the other or another portion of the refrigerant flowing from the indoor heat exchanger 130 to the second injection module 180. The first injection module 170 may not be operated on or when performing the defrosting operation, may bypass the refrigerant flowing from the second injection module 180, and may guide the bypassed refrigerant to the indoor expansion valve 150.

The first injection module 170 may include a first injection expansion valve 171 to expand some or a portion of the refrigerant, and a first injection heat exchanger 172 to heat-exchange and supercool the other or another portion of the refrigerant with the refrigerant expanded at the first injection expansion valve 171.

The first injection expansion valve 171 may be connected to the indoor expansion valve 150 and the first injection heat exchanger 172. An opening of the first injection expansion valve 171 may be controlled on or when performing the heating operation, and the first injection expansion valve 171 may expand the refrigerant injected from the indoor heat exchanger 130 into the compressor 110, and may be closed on or when performing the defrosting operation.

On or when performing the heating operation, the first injection expansion valve 171 may expand some or a portion of the refrigerant heat-exchanged at the indoor heat exchanger 130 and having passed through the indoor expansion valve 150, and guide the expanded refrigerant to the first injection heat exchanger 172. On or when performing the heating operation, the opening of the first injection expansion valve 171 may be controlled so that a pressure of the refrigerant is the same as a high pressure side pressure of the compressor 111 connected with the third inlet port 113.

The first injection expansion valve 171 may be closed on or when performing the defrosting operation, and therefore, the first injection module 170 may not be operated.

The first injection heat exchanger 172 may be connected to the indoor expansion valve 150, the first injection expansion valve 171, the second injection expansion valve 181, the second injection heat exchanger 182, and the third inlet port 113. The first injection heat exchanger 172 may heat-exchange refrigerant flowing from the indoor heat exchanger 130 with refrigerant expanded at the first injection expansion valve 171 on or when performing the heating operation, and pass the refrigerant flowing from the second injection module 180 without heat-exchange on or when performing the defrosting operation.

On or when performing the heating operation, the first injection heat exchanger 172 may heat-exchange some or a portion of the refrigerant heat-exchanged at the indoor heat exchanger 130 and having passed through the indoor expansion valve 150 with the refrigerant expanded at the first injection expansion valve 171. On or when performing the heating operation, the refrigerant supercooled at the first injection heat exchanger 172 may flow to the second injection module 180 and the refrigerant superheated at the first injection heat exchanger 172 may be injected into the third inlet port 113 of the compressor 110.

On or when performing the defrosting operation, when the first injection expansion valve 171 is closed, the first injection heat exchanger 172 may bypass the refrigerant flowing from the second injection module 180 and guide the bypassed refrigerant to the indoor expansion valve 150.

The above-described first injection module 170 may not include the first injection expansion valve 171 and the first injection heat exchanger 172, but rather, may be a liquid-vapor separator that separates vapor-phase refrigerant and liquid-phase refrigerant so that the vapor-phase refrigerant may be injected into the compressor 110.

The second injection module 180 may inject some or a portion of the refrigerant flowing between the outdoor heat exchanger 120 and the indoor heat exchanger 130 into the compressor 110 according to operation conditions. The second injection module 180 may expand some or a portion of the refrigerant flowing from the first injection module 170 to the outdoor heat exchanger 120 on or when performing the heating operation and inject the expanded refrigerant into the low pressure side of the compressor 110. The second injection module 180 may be connected to the first injection module 170, the second inlet port 112 of the compressor 110, and the outdoor expansion valve 140.

The second injection module 180 may guide some or a portion of the refrigerant flowing from the first injection module 170 into the second inlet port 112 of the compressor 110 on or when performing the heating operation, inject the refrigerant into the low pressure side of the compressor 110, and guide the other or another portion of the refrigerant flowing from the first injection module 170 to the outdoor expansion valve 140.

The second injection module 180 may guide some or a portion of the refrigerant flowing from the outdoor heat exchanger 120 to the second inlet port 112 of the compressor 110, inject the refrigerant into the low pressure side of the compressor 110, and guide the other or another portion of the refrigerant flowing from the outdoor heat exchanger 120 into the first injection module 170, according to defrosting injection conditions, which will be described hereinbelow, on or when performing the defrosting operation.

The second injection module 180 may not be operated according to the defrosting injection conditions on or when performing the defrosting operation, may bypass the refrigerant flowing from the outdoor heat exchanger 120, and may guide the bypassed refrigerant to the first injection module 170. The second injection module 180 may include a second injection expansion valve 181 to expand some or a portion of the refrigerant, and a second injection heat exchanger 182 to heat-exchange and supercool the other or another portion of the refrigerant with the refrigerant expanded at the second injection expansion valve 181.

The second injection expansion valve 181 may be connected to the first injection heat exchanger 172 and the second injection heat exchanger 182. The second injection expansion valve 181 may expand the refrigerant injected from the indoor heat exchanger 130 into the compressor 110.

On or when performing the heating operation, the second injection expansion valve 181 may expand some or a portion of the refrigerant discharged and diverted from the first injection heat exchanger 172 and guide the discharged and diverted refrigerant to the second injection heat exchanger 182. On or when performing the heating operation, an opening of the second injection expansion valve 181 may be controlled so that a pressure of the refrigerant is the same as a low pressure side pressure of the compressor 111 connected with the second inlet port 112.

On or when performing the defrosting operation, the second injection expansion valve 181 may expand some or a portion of the refrigerant heat-exchanged at the outdoor heat exchanger 120 and having passed through the outdoor expansion valve 140 and may guide the expanded refrigerant to the second injection heat exchanger 182. On or when performing the defrosting operation, the second injection expansion valve 181 may be closed and the second injection module 180 may be not operated.

The second injection heat exchanger 182 may be connected to the first injection heat exchanger 172, the second injection expansion valve 181, the second inlet port 112 of the compressor 110, and the outdoor expansion valve 140. The second injection heat exchanger 182 may heat-exchange the refrigerant flowing from the first injection module 170 with the refrigerant expanded at the second injection expansion valve 181 on or when performing the heating operation, and heat-exchange the refrigerant flowing from the outdoor heat exchanger 120 with the refrigerant expanded at the second injection expansion valve 181 on or when performing the defrosting operation or may pass the refrigerant without heat-exchanging.

On or when performing the heating operation, the second injection heat exchanger 182 may heat-exchange some or a portion of the refrigerant discharged and diverted from the first injection heat exchanger 172 with the refrigerant expanded at the second injection expansion valve 181. On or when performing the heating operation, the refrigerant supercooled at the second injection heat exchanger 182 may flow to the outdoor expansion valve 140 and the refrigerant superheated at the second injection heat exchanger 182 may be injected into the second inlet port 112 of the compressor 110.

On or when performing the defrosting operation, the second injection expansion valve 182 may heat-exchange the refrigerant heat-exchanged at the outdoor heat exchanger 120 and having passed through the outdoor expansion valve 140 with the refrigerant expanded at the second injection expansion valve 181. On or when performing the defrosting operation, the refrigerant supercooled at the second injection heat exchanger 182 may be flow into the first injection module 170 and the refrigerant superheated at the second injection heat exchanger 182 may be injected into the second inlet port 112 of the compressor 110.

When the second injection expansion valve 181 is closed on or when performing the defrosting operation, the second injection heat exchanger 182 may bypass the refrigerant heat-exchanged at the outdoor heat exchanger 120 and flowing from the outdoor expansion valve 140 and guide the bypassed refrigerant to the first injection module 170.

The above-described second injection module 180 may not include the second injection expansion valve 181 and the second injection heat exchanger 182, but rather, may be a liquid-vapor separator that separates vapor-phase refrigerant and liquid-phase refrigerant so that the vapor-phase refrigerant may be injected into the compressor 110.

Hereinafter, the heating operation of the air conditioner will be described according to an embodiment with reference to FIG. 1.

The refrigerant compressed at the compressor 110 may be discharged from the discharge port 114 to flow into the valve unit 190. On or when performing the heating operation, the valve unit 190 may connect the discharge port 114 of the compressor 110 and the indoor heat exchanger 130, and therefore, the refrigerant flowing into the valve unit 190 may flow to the indoor heat exchanger 130.

The refrigerant flowing from the valve unit 190 to the indoor heat exchanger 130 may be heat-exchanged with indoor air and the heat-exchanged refrigerant may be condensed. The refrigerant condensed at the indoor heat exchanger 130 may flow to the indoor expansion valve 150. On or when performing the heating operation, the indoor expansion valve 150 may be completely opened, pass the refrigerant therethrough, and guide the passed refrigerant to the first injection module 170.

Some or a portion of the refrigerant flowing from the indoor expansion valve 150 may flow to the first injection expansion valve 171, and the other or another portion of the refrigerant may be guided to the first injection heat exchanger 172. The refrigerant flowing into the first injection expansion valve 171 may be expanded and flow into the first injection heat exchanger 172. The refrigerant expanded at the first injection expansion valve 171 may be guided into the first injection heat exchanger 172, heat-exchanged with the refrigerant flowing from the indoor expansion valve 150 to the first injection heat exchanger 172, and the heat-exchanged refrigerant may be evaporated. The refrigerant evaporated at the first injection heat exchanger 172 may flow into the third inlet port 113 of the compressor 110. The refrigerant flowing into the third inlet port 113 of the compressor 110 may be injected into the high pressure side of the compressor 110, the injected refrigerant may be compressed, and the compressed refrigerant may be discharged to the discharge port 114.

Some or a portion of the refrigerant flowing from the indoor expansion valve 150 may be heat-exchanged with the refrigerant expanded by the first injection expansion valve 171 at the first injection heat exchanger 172, and the heat-exchanged refrigerant may be supercooled. The refrigerant supercooled at the first injection heat exchanger 172 may flow to the second injection module 180.

Some or a portion of the refrigerant flowing from the first injection heat exchanger 172 may flow to the second injection expansion valve 181, and the other or another portion of the refrigerant may be guided to the second injection heat exchanger 182. The refrigerant flowing into the second injection expansion valve 181 may be expanded and flow to the second injection heat exchanger 182. The refrigerant expanded at the second injection expansion valve 181 may be guided to the second injection heat exchanger 182, the guided refrigerant may be heat-exchanged with the refrigerant flowing from the first injection heat exchanger 172 to the second injection heat exchanger 182, and the heat-exchanged refrigerant may be evaporated. The refrigerant evaporated at the second injection heat exchanger 182 may flow into the second inlet port 112 of the compressor 110. The refrigerant flowing into the second inlet port 112 may be injected into the low pressure side of the compressor 110, the injected refrigerant may be compressed, and the compressed refrigerant may be discharged to the discharge port 114.

Some or a portion of the refrigerant flowing from the first injection heat exchanger 172 may be heat-exchanged with the refrigerant expanded by the second expansion valve 181 at the second injection heat exchanger 182, and the heat-exchanged refrigerant may be supercooled. The refrigerant supercooled at the second injection heat exchanger 182 may be guided to the outdoor expansion valve 140.

The refrigerant flowing into the outdoor expansion valve 140 may be expanded and guided to the outdoor heat exchanger 120. The refrigerant flowing into the outdoor heat exchanger 120 may be heat-exchanged with outdoor air, and therefore, the heat-exchanged refrigerant may be evaporated. The refrigerant evaporated at the outdoor heat exchanger 120 may flow to the valve unit 190.

The valve unit 190 may connect the outdoor heat exchanger 120 to the liquid-vapor separator 160 on or when performing the heating operation, and therefore, the refrigerant flowing from the outdoor heat exchanger 120 to the valve unit 190 may flow into the liquid-vapor separator 160. The refrigerant flowing into the liquid-vapor separator 160 may be separated into vapor-phase refrigerant and liquid-phase refrigerant. The vapor-phase refrigerant separated from the liquid-vapor separator 160 may be introduced to the first inlet port 111 of the compressor 110. The refrigerant flowing into the first inlet port 111 may be compressed at the compressor 110, and then, the compressed refrigerant may be discharged to the discharge port 114.

Figure 2:
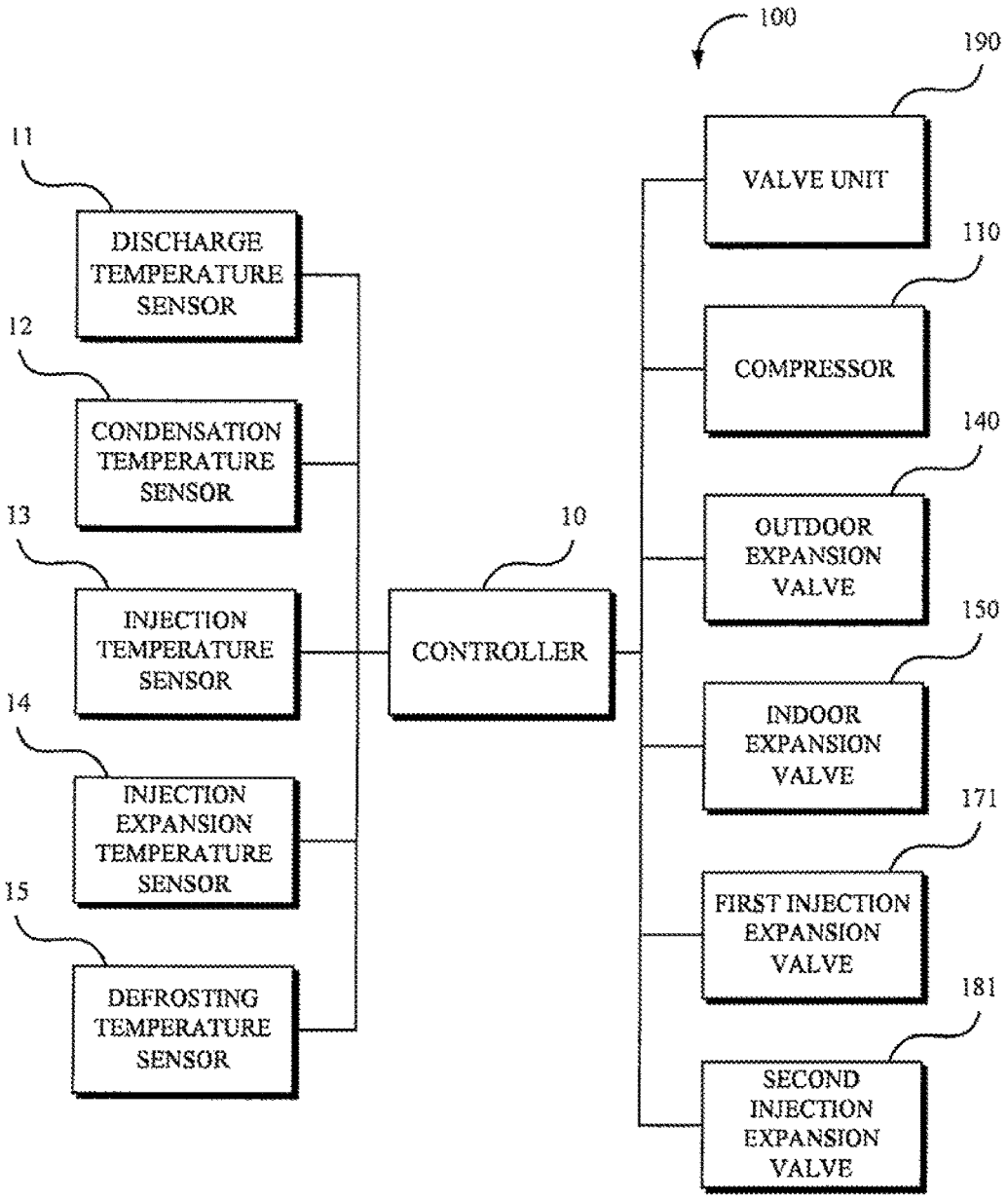
FIG. 2 is a block view of the air-conditioner according to an embodiment.

FIG. 2 is a block view of the air conditioner according to an embodiment. Referring to FIG. 2, the air conditioner 100 according to an embodiment may include a controller 10 to control the air conditioner 100, a discharge temperature sensor 11 to measure a discharge temperature of the refrigerant discharged from the compressor 110, a condensation temperature sensor 12 to measure a condensation temperature on condensing the refrigerant, an injection temperature sensor 13 to measure an injection temperature of the refrigerant injected from the second injection module 180 to the compressor 110, an injection expansion temperature sensor 14 to measure an evaporation temperature of the refrigerant at the second injection module 180, and a defrosting temperature sensor 15 to determine whether a defrosting operation should be performed.

The controller 10, which may control operations of the air conditioner 100, may control the valve unit 190, the compressor 110, the outdoor expansion valve 140, the indoor expansion valve 150, the first injection expansion valve 171, and the second injection expansion valve 181. The controller 10 may control the valve unit 190 to switch between the heating operation and the defrosting operation. The controller 10 may control an operation velocity of the compressor according to load. The controller 10 may control an opening of the outdoor expansion valve 140 on or when performing the heating operation and open the outdoor expansion valve 140 on or when performing the defrosting operation. The controller 10 may open the indoor expansion valve 150 on or when performing the heating operation and control an opening of the indoor expansion valve 150 on or when performing the defrosting operation.

The controller 10 may control the opening of the first injection expansion valve 171 on or when performing the heating operation and may close the first injection expansion valve 171 on or when performing the defrosting operation. The controller 10 may control the opening of the second injection expansion valve 181 on or when performing the heating operation and may control or close the opening of the second injection expansion valve 181 on or when performing the defrosting operation.

The discharge temperature sensor 11 may measure the discharge temperature (at point b) of the refrigerant compressed at the compressor 110 and discharged to the discharge port 114. The discharge temperature sensor 11 may be disposed at various points, may measure a temperature of the refrigerant discharged from the compressor 110, and may be disposed at the point b according to this embodiment.

The condensation temperature sensor 12 may measure the condensation temperature of the refrigerant at the indoor heat exchanger 130 on or when performing the heating operation and measure the condensation temperature of the refrigerant at the outdoor heat exchanger 120 on or when performing the defrosting operation. The condensation temperature sensor 12 may be disposed at various points, may measure the condensation temperature of the refrigerant, and may be disposed at point d on or when performing the heating operation and at point h on or when performing the defrosting operation according to this embodiment. The condensation temperature sensor 12 may be disposed at the indoor heat exchanger 130 on or when performing the heating operation and disposed at the outdoor heat exchanger 120 on performing the defrosting operation according to this embodiment. According to this embodiment, the condensation temperature sensor 12 may measure and convert a pressure of the refrigerant flowing to the indoor heat exchanger 130 on or when performing the heating operation, and measure and convert a pressure of the refrigerant flowing to the outdoor heat exchanger 120 on or when performing the defrosting operation.

The injection temperature sensor 13 may measure the injection temperature (at point m) of the refrigerant evaporated at the second injection heat exchanger 182 and injected into the low pressure side of the compressor 110 through the second inlet port 112. The injection temperature sensor 13 may be disposed at various points, may measure the temperature of the refrigerant injected into the low pressure side of the compressor 110, and may be disposed at the point m according to this embodiment.

The injection expansion temperature sensor 14 may measure the temperature of the refrigerant expanded at the second injection expansion valve 181, that is, the injection expansion temperature at point l). The injection expansion temperature sensor 14 may be disposed at various points, may measure the injection expansion temperature of the refrigerant to be injected, and may be disposed at the point l according to this embodiment.

The defrosting temperature sensor 15 may determine whether the defrosting conditions are satisfied. The defrosting temperature sensor 15 may be disposed at point d or point c in the outdoor heat exchanger 120 or surrounding pipes thereof to measure the temperature. The defrosting temperature sensor 15 may be disposed at the outdoor heat exchanger 120 to measure the temperature according to this embodiment.

Figure 3:
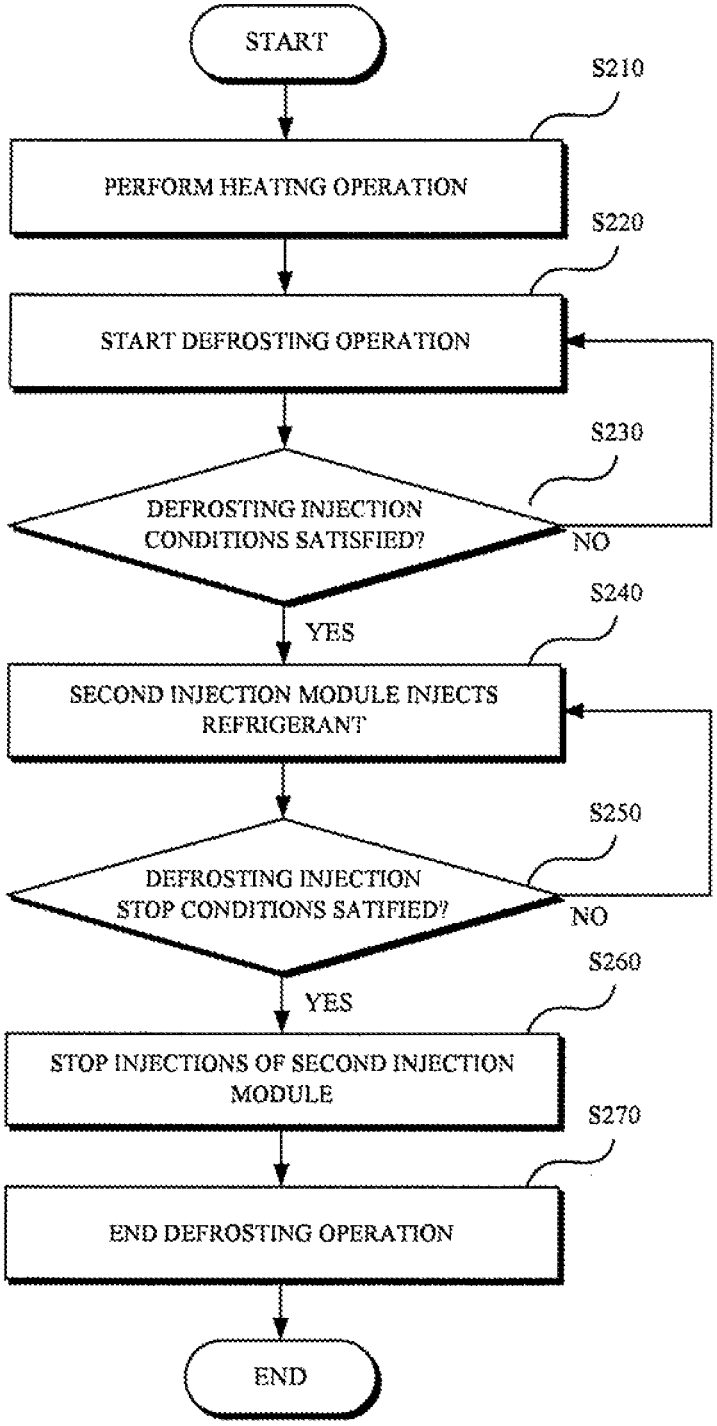
FIG. 3 is a flow chart of a method for controlling an air conditioner on or when performing a defrosting operation according to an embodiment.
Figure 4:
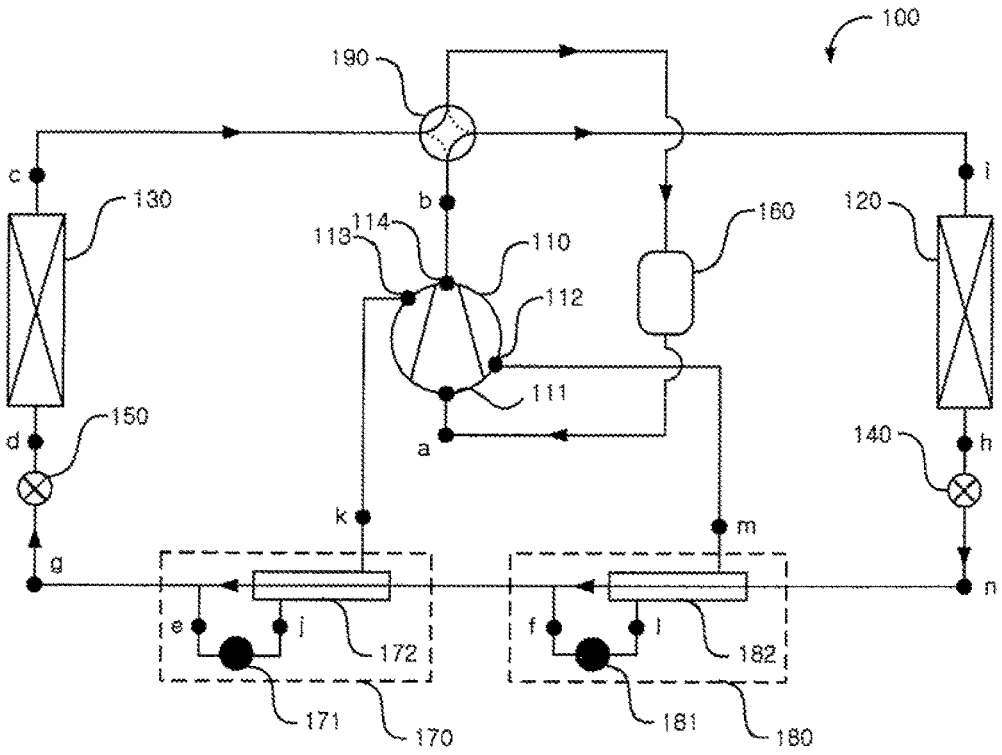
FIG. 4 is a schematic diagram illustrating when the air conditioner according to an embodiment does not perform injections on or when performing the defrosting operation.
Figure 5:
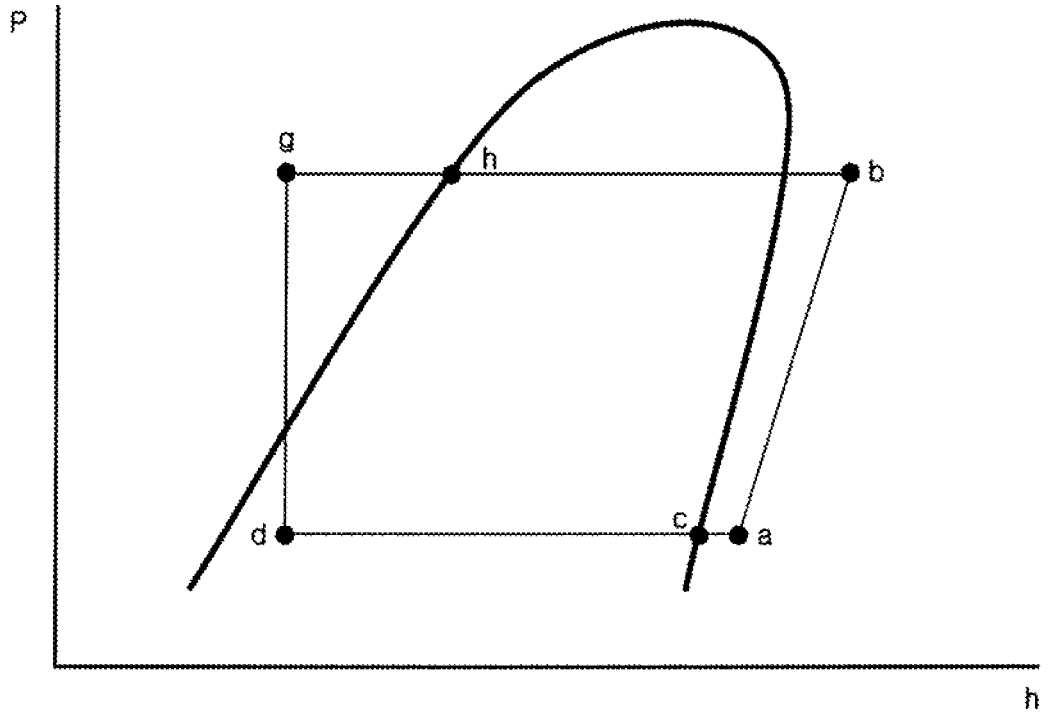
FIG. 5 is a Pressure-Enthalpy Diagram (hereinafter, refers to as a "P-h Diagram") of the air conditioner of FIG. 4.
Figure 6:
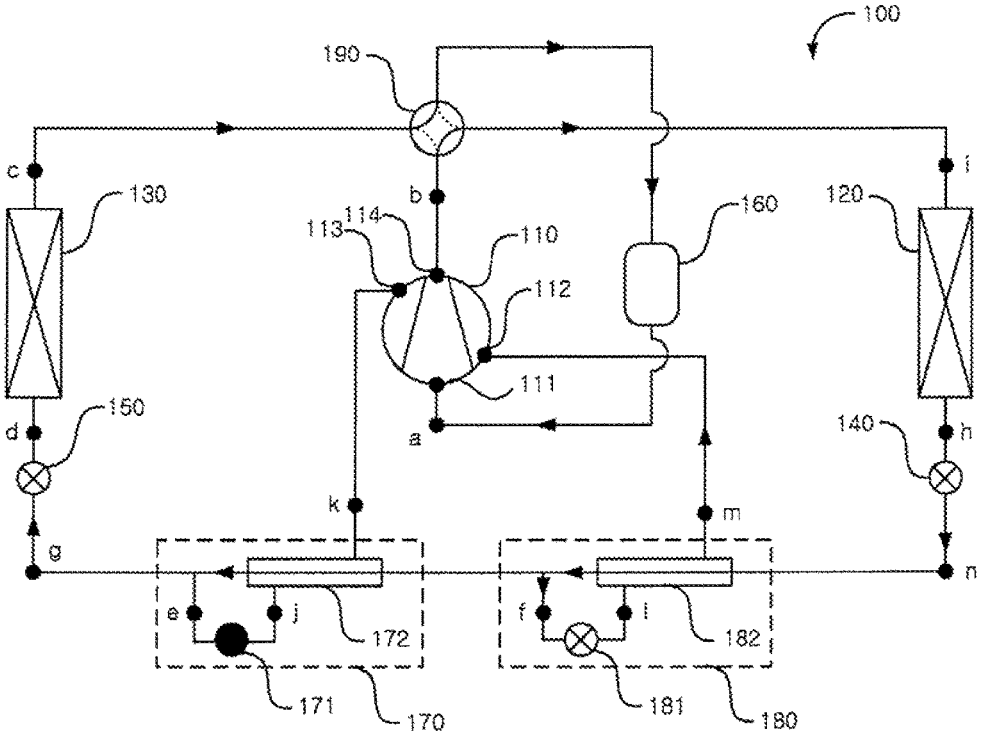
FIG. 6 is a schematic diagram illustrating when a second injection module of the air-conditioner according to an embodiment performs injections on or when performing the defrosting operation.
Figure 7:
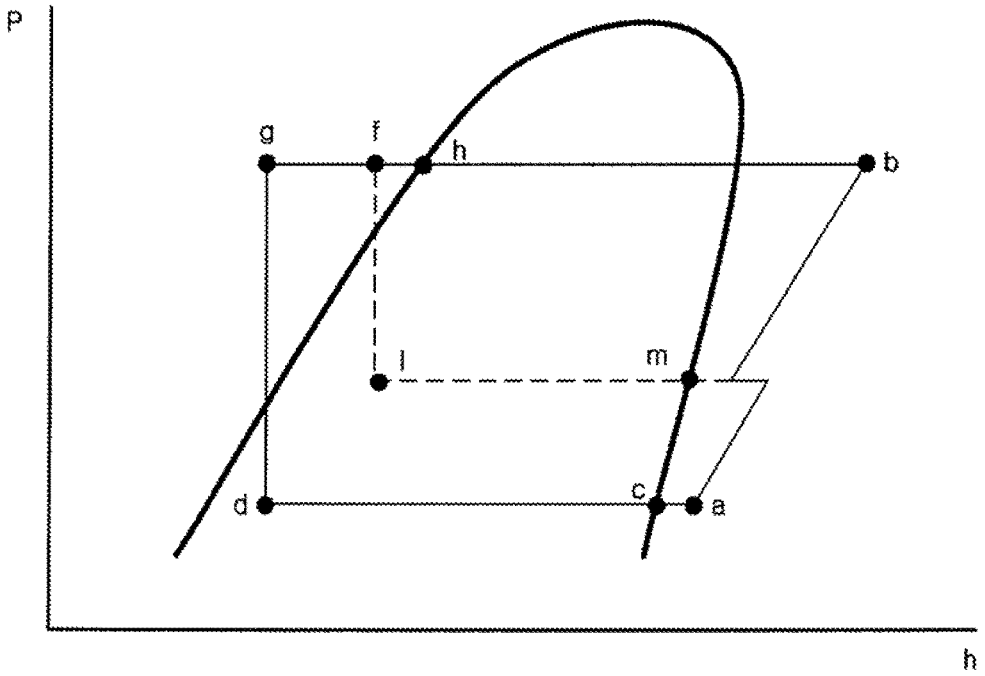
FIG. 7 is a P-h Diagram of the air conditioner of FIG. 6.

FIG. 3 is a flow chart of a method for controlling an air conditioner on or when performing a defrosting operation according to an embodiment. FIG. 4 is a schematic diagram illustrating when the air conditioner according to an embodiment does not perform injections on or when performing a defrosting operation. FIG. 5 is a Pressure-Enthalpy Diagram (hereinafter, refers to as a "P-h Diagram") of the air conditioner of FIG. 4. FIG. 6 is a schematic diagram illustrating when a second injection module of the air-conditioner according to an embodiment performs injections on or when the defrosting operation. FIG. 7 is the P-h Diagram of the air conditioner of FIG. 6.

The controller 10 may perform the heating operation, in step S210. The controller 10 may perform the heating operation according to settings of a user or an indoor temperature, for example. On or when performing the heating operation, operation of the air conditioner is discussed above with reference to FIG. 1.

The controller 10 may start the defrosting operation on satisfying defrosting conditions, in step S220. The defrosting conditions may be set to a temperature measured by the defrosting temperature sensor 15. The controller 10 may determine that the defrosting conditions are satisfied when the temperature measured by the defrosting temperature sensor 15 is below the set temperature. The controller 10 may automatically perform the defrosting operation on satisfying the defrosting conditions.

The controller 10 may switch the valve unit 190 on satisfying the defrosting conditions during the heating operation, connect the discharge port 114 and the outdoor heat exchanger 120, and connect the first inlet port 111 of the compressor 110 and the indoor heat exchanger 130. The controller 10 may completely open the outdoor expansion valve 140 according to control logics of the defrosting operation, and control the operation velocity of the compressor 110 and the opening of the indoor expansion valve 150. The controller 10 may close the first injection expansion valve 171 and the second injection expansion valve 181, so that the first injection module 170 and the second injection module 180 are not operated on starting the defrosting operation.

Operation of the air conditioner according to an embodiment on or when starting the defrosting operation will be described with reference to FIG. 4 and FIG. 5. The refrigerant compressed at the compressor 110 may be discharged from the discharge port 114, pass through point b, and flow into the valve unit 190. On or when performing the defrosting operation, the valve unit 190 may connect the discharge port 114 of the compressor 110 and the outdoor heat exchanger 120, and therefore, the refrigerant flowing into the valve unit 190 may pass through point i and flow to the outdoor heat exchanger 120.

The refrigerant flowing from the valve unit 190 to the outdoor heat exchanger 120 may be heat-exchanged with outdoor air and the heat-exchanged refrigerant may be condensed. The refrigerant condensed at the outdoor heat exchanger 120 may remove frost generated at the outdoor heat exchanger 120.

The refrigerant condensed at the outdoor heat exchanger 120 may pass through the point h, and flow into the outdoor expansion valve 140. On or when performing the defrosting operation, the outdoor expansion valve 140 may be completely opened, and therefore, may pass the refrigerant and guide the passed refrigerant to the second injection module 180.

The second injection expansion valve 181 of the second injection module 180 may be closed on or when starting the defrosting operation, and therefore, the refrigerant flowing into the second injection module 180 may pass through the second injection heat exchanger 182 and may flow into the first injection module 170. The first injection expansion valve 171 of the first injection module 170 may be closed on or when starting the defrosting operation, and therefore, the refrigerant flowing into the first injection module 170 may pass through the first injection heat exchanger 172 and flow into the indoor expansion valve 150 via point g.

The refrigerant expanded at the indoor expansion valve 150 may be expanded, pass through the point d, and be guided to the indoor heat exchanger 130. The refrigerant flowing into the indoor heat exchanger 130 may be heat-exchanged with indoor air, and therefore, the heat-exchanged refrigerant may be evaporated. The refrigerant evaporated at the indoor heat exchanger 130 may flow into the valve unit 190 via the point c.

The valve unit 190 may connect the indoor heat exchanger 130 to the liquid-vapor separator 160 on or when performing the defrosting operation, and therefore, the refrigerant flowing from the indoor heat exchanger 130 to the valve unit 190 may flow into the liquid-vapor separator 160. The refrigerant flowing into the liquid-vapor separator 160 may be separated into vapor-phase refrigerant and liquid-phase refrigerant. The vapor-phase refrigerant separated from the liquid-vapor separator 160 may be introduced into the first inlet port 111 of the compressor 110 via point a. The refrigerant flowing into the first inlet port 111 may be compressed at the compressor 110, and then, the compressed refrigerant may be discharged to the discharge port 114.

Referring to FIG. 5, as the first injection module 170 and the second injection module 180 are not operated on or when starting the defrosting operation, there is no refrigerant injected into the compressor 110. An outdoor temperature may be low on or when performing the defrosting operation, and therefore, the refrigerant in the outdoor heat exchanger 120 may not be smoothly condensed, and therefore, efficiency of the air conditioner may be very low, thereby increasing the operation velocity of the compressor 110, increasing a defrosting operation time, and reducing flow of the refrigerant.

The controller 10 may determine that the defrosting injection conditions are satisfied, in step S230. The defrosting injection conditions may be set to the operation velocity of the compressor 110 and/or a discharge superheat. The operation velocity of the compressor 110, which is a rotational velocity of a motor (not shown) that generates a rotational force to compress the refrigerant in the compressor 110, may be represented in frequencies. The operation velocity of the compressor 110 may be proportional to a compression capacity of the compressor 110. The controller 10 may determine whether the operation velocity of the compressor 110 is higher than a preset or predetermined reference operation velocity to determine whether the defrosting injection conditions are satisfied.

The discharge superheat is a difference between the discharge temperature measured by the discharge temperature sensor 11 and the condensation temperature measured by the condensation temperature sensor 12. That is, (the discharge superheat) equals (the discharge temperature)−(condensation temperature). The controller 10 may determine whether the discharge superheat is higher than a preset or predetermined discharge superheat to determine whether the defrosting injection conditions are satisfied. According to an embodiment, the defrosting injection conditions may be set so that one or both of the operation velocity of compressor 110 and the discharge superheat described above is satisfied for the conditions.

The second injection module 180 may inject the refrigerant into the compressor 110 on satisfying the defrosting injection conditions, in step S240. On satisfying the defrosting injection conditions, the first injection module 170 may not be operated and the second injection module 170 may only be operated to inject the refrigerant into the low pressure side of the compressor 110. The controller 10 may open the second injection expansion valve 181 to operate the second injection module 180 and control the opening thereof.

Referring to FIG. 6 and FIG. 7, when the first injection module 170 is not operated and the second injection module 180 injects the refrigerant into the compressor 110 in a case in which the defrosting injection conditions are satisfied, operation of the air conditioner will be described hereinbelow.

The refrigerant compressed at the compressor 110 may be discharged from the discharge port 114, pass through the point b, and flow into the valve unit 190.

The valve unit 190 may connect the discharge port 114 of the compressor 110 and the outdoor heat exchanger 120 on or when performing the defrosting operation, and therefore, the refrigerant flowing into the valve unit 190 may passes through the point i and flow to the outdoor heat exchanger 120.

The refrigerant flowing from the valve unit 190 to the outdoor heat exchanger 120 may be heat-exchanged with outdoor air and the heat-exchanged refrigerant may be condensed. The refrigerant condensed at the outdoor heat exchanger 120 may pass through the point h, and flow to the outdoor expansion valve 140. The outdoor expansion valve 140 may completely be opened on or when performing the defrosting operation, and therefore, may pass the refrigerant therethrough, and guide the refrigerant into the second injection module 180.

On satisfying the defrosting injection conditions, as the second injection expansion valve 181 of the second injection module 180 may be opened and the opening thereof controlled, the refrigerant flowing into the second injection module 180 may be supercooled at the second injection heat exchanger 182. Some or a portion of the refrigerant supercooled at the second injection heat exchanger 182 may pass through point f and be guided to the second injection expansion valve 181. The refrigerant expanded at the second injection expansion valve 181 may pass through the point l, may be heat-exchanged with the refrigerant flowing from the outdoor heat exchanger 120 at the second injection heat exchanger 182, and the heat-exchanged refrigerant may be evaporated.

The refrigerant evaporated at the second injection heat exchanger 182 may pass through the point m and flow into the second inlet port 112 of the compressor 110. The refrigerant flowing into the second inlet port 112 may be injected into the low pressure side of the compressor 110, the injected refrigerant may be compressed, and the compressed refrigerant may be discharged to the discharge port 114. The refrigerant supercooled at the second injection heat exchanger 182 may flow into the first injection module 170.

Even on satisfying the defrosting injection conditions, the first injection expansion valve 171 of the first injection module 170 may be closed, and therefore, the refrigerant flowing into the first injection module 170 may pass through the first injection heat exchanger 172 and flow into the indoor expansion valve 150 via the point g. The refrigerant expanded at the indoor expansion valve 150 may pass through the point d and may be guided into the indoor heat exchanger 130. The refrigerant flowing into the indoor heat exchanger 130 may be heat-exchanged with indoor air, and therefore, the heat-exchanged refrigerant may be evaporated. The refrigerant evaporated at the indoor heat exchanger 130 may be flow to the valve unit 190 via the point c.

The valve unit 190 may connect the indoor heat exchanger 130 to the liquid-vapor separator 160 on or when performing the defrosting operation, and therefore, the refrigerant flowing from the indoor heat exchanger 130 to the valve unit 190 may flow into the liquid-vapor separator 160. The refrigerant flowing into the liquid-vapor separator 160 may be separated into vapor-phase refrigerant and liquid-phase refrigerant. The vapor-phase refrigerant separated from the liquid-vapor separator 160 may be introduced into the first inlet port 111 of the compressor 110 via the point a. The refrigerant flowing into the first inlet port 111 may be compressed at the compressor 110, and then, the compressed refrigerant may be discharged to the discharge port 114.

Referring to FIG. 7, on satisfying the defrosting injection conditions, the first injection module 170 may not be operated and the second injection module 180 may be operated to inject the refrigerant into the low pressure side of the compressor 110. When the second injection module 180 injects the refrigerant into the low pressure side of the compressor 110, the flow of the refrigerant may be increased and efficiency of the air conditioner enhanced, and therefore, the operation velocity of the compressor 110 may be reduced.

The controller 10 may determine whether defrosting injection stop conditions are satisfied, in step S250. The defrosting injection stop conditions may be set by an injection superheat.

The injection superheat may be a temperature difference between the injection temperature (at point m) of the refrigerant, measured by the injection temperature sensor 13, evaporated at the second injection heat exchanger 182 and injected into the low pressure side of the compressor 110 via the second inlet port 112, and a temperature of the refrigerant, measured by the injection expansion temperature sensor 14, expanded at the second injection expansion valve 181, that is, the injection expansion temperature (at point i). That is, (the injection superheat) equals (the injection temperature)−(the injection expansion temperature). The controller 10 may determine whether the injection superheat is higher than a preset or predetermined reference injection superheat to determine whether the defrosting injection stop conditions are satisfied.

The controller 10 may stop the injection of the second injection module 180 on satisfying the defrosting injection stop conditions, in step S260. The second injection module 180 may not be operated on satisfying the defrosting injection stop conditions. The controller 10 may close the second injection expansion valve 181 to not operate the second injection module 180. When the second injection module 180 is not operated, the air conditioner may be operated as shown in FIG. 4 and FIG. 5.

The controller 10 may end the defrosting operation on satisfying defrosting stop conditions, in step S270. The defrosting stop conditions may be set to a temperature measured by the defrosting temperature sensor 15 and/or a defrosting operation time. The controller 10 may determine the defrosting stop conditions are satisfied when the temperature measured by the defrosting temperature sensor 15 is above the set temperature or the defrosting operation time is above a preset or predetermined reference time. The controller 10 may automatically end the defrosting operation on satisfying the defrosting stop conditions and perform the heating operation.

The controller 10 may switch the valve unit 190 on satisfying the defrosting stop conditions, connect the discharge port 114 of the compressor 110 and the indoor heat exchanger 130, and connect the outdoor heat exchanger 120 and the liquid-vapor separator 160. The controller 10 may completely open the indoor expansion valve 150 according to control logics of the heating operation, and control the operation velocity of the compressor 110 and the opening of the outdoor expansion valve 140. The air conditioner may be operated as shown in FIG. 1 when the defrosting operation is ended and the heating operation starts.

An air conditioner and a method for controlling an air conditioner according to embodiments disclosed herein may have at least the following advantages.

First, refrigerant may be injected into the compressor on or when performing a defrosting operation, thereby preventing overload of the compressor and enhancing defrosting efficiency.

Second, the refrigerant may be injected into the compressor on or when performing the defrosting operation, thereby increasing flow of the refrigerant and enhancing the defrosting efficiency.

Third, conditions for injecting the refrigerant may be set on or when performing the defrosting operation, thereby suitably injecting the refrigerant.

Embodiments disclosed herein provide an air conditioner and a method for controlling an air conditioner that injects a refrigerant into a compressor on or when performing a defrosting operation.

Embodiments are not limited to the mentioned problems, and other problems, which are not described, may be obviously understood to those skilled in the art from the description.

Embodiments disclosed herein provide an air conditioner that may include a compressor to compress a refrigerant; an outdoor heat exchanger, disposed at or in an outside or outdoor space, to heat-exchange outdoor air with the refrigerant; an indoor heat exchanger, disposed at or in an indoor space, to heat-exchange indoor air with the refrigerant; a valve unit or valve to guide the refrigerant discharged from the compressor to the indoor heat exchanger on or when performing a heating operation and to guide the refrigerant discharged from the compressor to the outdoor heat exchanger on or when performing the defrosting operation; a first injection module that injects some or a portion of the refrigerant flowing from the indoor heat exchanger to the outdoor heat exchanger into the compressor on or when performing the heating operation and that does not inject some or a portion of the refrigerant flowing from the outdoor heat exchanger to the indoor heat exchanger into the compressor on or when performing the defrosting operation; and a second injection module that injects some or a portion of the refrigerant flowing from the indoor heat exchanger to the outdoor heat exchanger into the compressor on or when performing the heating operation and that injects some or a portion of the refrigerant flowing from the outdoor heat exchanger to the indoor heat exchanger into the compressor on or when performing the defrosting operation.

Embodiments disclosed herein further provide a method for controlling an air conditioner that may include a compressor to compress a refrigerant; an outdoor heat exchanger, disposed at or in an outdoor space, to heat-exchange outdoor air with the refrigerant; an indoor heat exchanger, disposed at or in an indoor space, to heat-exchange indoor air with the refrigerant; a valve unit or valve to guide the refrigerant discharged from the compressor to the indoor heat exchanger on or when performing a heating operation; a first injection module that injects some or a portion of the refrigerant flowing from the indoor heat exchanger to the outdoor heat exchanger into the compressor on or when performing the heating operation: and a second injection module that injects some or a portion of the refrigerant flowing from the indoor heat exchanger to the outdoor heat exchanger into the compressor on or when performing the heating operation. The method may include guiding the refrigerant discharged from the compressor to the outdoor heat exchanger by the valve unit or valve during the heating operation and starting the defrosting operation; and expanding some or a portion of the refrigerant flowing from the outdoor heat exchanger to the indoor heat exchanger by the second injection module and injecting the expanded refrigerant into the compressor on satisfying defrosting injection conditions.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a compressor to compress a refrigerant;

an outdoor heat exchanger, disposed at an outdoor space, to heat-exchange outdoor air with the refrigerant;

an indoor heat exchanger, disposed at an indoor space, to heat-exchange indoor air with the refrigerant;

a valve to guide the refrigerant discharged from the compressor to the indoor heat exchanger when performing a heating operation and to guide the refrigerant discharged from the compressor to the outdoor heat exchanger when performing a defrosting operation;

a first injection including a first injection expansion valve to expand a first portion of the refrigerant, and a first injection heat exchanger to heat-exchange a second portion of the refrigerant with the first portion of the refrigerant expanded at the first injection expansion valve to supercool the heat-exchanged refrigerant;

a second injection module including a second injection expansion valve to expand a first portion of the refrigerant, and a second injection heat exchanger to heat-exchange a second portion of refrigerant with the first portion of the refrigerant expanded at the second injection expansion valve to supercool the heat-exchanged refrigerant; and a controller that controls the first injection module and the second injection module, wherein the controller controls the first injection module to inject a portion of the refrigerant flowing from the indoor heat exchanger to the outdoor heat exchanger into the compressor when performing the heating operation and to not inject a portion of the refrigerant flowing from the outdoor heat exchanger to the indoor heat exchanger into the compressor when performing the defrosting operation, and during the performing of the defrosting operation, controls the second injection module to inject the refrigerant into the compressor when an operation velocity of the compressor is higher than a predetermined reference operation velocity and/or when a discharge superheat, that is, a difference between a temperature of the refrigerant discharged from the compressor and a temperature of the refrigerant condensed in the outdoor heat exchanger, is higher than a predetermined reference discharge superheat, and during the performing of the defrosting operation, controls the second injection module to stop the injection of the refrigerant when an injection superheat, that is, a difference between a temperature of the refrigerant injected into the compressor and a temperature of the refrigerant expanded at the second injection expansion valve, is higher than a predetermined reference injection superheat.

2. The air conditioner according to claim 1, wherein the first injection module injects the refrigerant into a high pressure side of the compressor, and the second injection module injects the refrigerant into a low pressure side of the compressor.

3. The air conditioner according to claim 1, further comprising a liquid-vapor separator disposed between the valve and the compressor, wherein the liquid-vapor separator separates the refrigerant into vapor-phase refrigerant and liquid-phase refrigerant and introduces the vapor-phase refrigerant into the compressor.

4. The air conditioner according to claim 1, further comprising:

an indoor expansion valve disposed between the indoor heat exchanger and the first injection module; and an outdoor expansion valve disposed between the outdoor heat exchanger and the second injection module.

5. The air conditioner according to claim 4, further comprising:

a discharge sensor that senses a discharge temperature of the refrigerant discharged from the compressor;

a condensation temperature sensor that senses an injection temperature of the refrigerant injected into the compressor from the second injection module;

an injection expansion temperature sensor that senses an evaporation temperature of the refrigerant at the second injection module; and a defrosting temperature sensor that senses a temperature to determine whether the defrosting operation should be performed.

6. The air conditioner according to claim 4, wherein the controller controls the valve, the compressor, the outdoor expansion valve, and the indoor expansion valve.

7. The air conditioner according to claim 6, wherein the controller, when performing the heating operation, opens the first injection valve and opens the second injection valve.

8. The air conditioner according to claim 6, wherein the controller, when starting the defrosting operation closes the first injection valve and closes the second injection valve.

9. The air conditioner according to claim 6, wherein the controller, when performing the defrosting operation closes the first injection valve and opens the second injection valve.

10. A method for controlling an air conditioner including a compressor to compress a refrigerant, an outdoor heat exchanger, disposed at an outdoor space, to heat-exchange outdoor air with the refrigerant, an indoor heat exchanger, disposed at an indoor space, to heat-exchange indoor air with the refrigerant, a valve to guide the refrigerant discharged from the compressor to the indoor heat exchanger when performing a heating operation, a first injection module that injects a portion of the refrigerant flowing from the indoor heat exchanger to the outdoor heat exchanger into the compressor when performing the heating operation, and a second injection module that injects a portion of the refrigerant flowing from the indoor heat exchanger to the outdoor heat exchanger into the compressor when performing the heating operation, the method comprising:

guiding the refrigerant discharged from the compressor to the outdoor heat exchanger by the valve during the heating operation and starting a defrosting operation;

expanding a first portion of the refrigerant flowing from the outdoor heat exchanger to the indoor heat exchanger by the second injection module and injecting the expanded refrigerant into the compressor when an operation velocity of the compressor is higher than a predetermined reference operation velocity during the performing of the defrosting operation and/or when a discharging superheat, that is, a difference between a temperature of the refrigerant discharged from the compressor and a temperature of the refrigerant condensed in the outdoor heat exchanger, is higher than a predetermined reference discharge superheat during the performing of the defrosting operation; and stopping the injection of the second injection module when an injection superheat, that is, a difference between a temperature of the refrigerant injected into the compressor and a temperature of the refrigerant expanded at the injection expansion valve, is higher than a predetermined reference injection superheat during the performing of the defrosting operation.

11. The method for controlling the air conditioner according to claim 10, wherein the second injection module includes an injection expansion valve to expand the first portion of the refrigerant and an injection heat exchanger to heat-exchange a second portion of the refrigerant with the first portion of the refrigerant expanded at the injection expansion valve to supercool the heat-exchanged refrigerant.

* * * * *